US005174056A

United States Patent [19]

King

[11] Patent Number: 5,174,056

[45] Date of Patent: Dec. 29, 1992

[54] DISPLAY SYSTEM

[75] Inventor: William H. King, Mississauga, Canada

[73] Assignee: King Products Limited, Ontario, Canada

[21] Appl. No.: 638,216

[22] Filed: Jan. 7, 1991

[51] Int. Cl.[5] ..... D06C 3/08

[52] U.S. Cl. ..... 40/574; 267/180; 40/575

[58] Field of Search ..... 40/574, 568, 569, 603, 40/398, 156, 158.1; 292/251.8, DIG. 7, DIG. 4; 70/276; 267/166, 180

[56] References Cited

U.S. PATENT DOCUMENTS

| | | | |
|---|---|---|---|
| 894,754 | 7/1908 | Snaman | 49/398 |
| 1,015,579 | 1/1912 | Mulford | 49/398 |
| 1,707,013 | 3/1929 | Hoegger | 49/398 |
| 1,837,916 | 12/1931 | Micheleman | 49/398 |
| 2,885,710 | 5/1959 | Brasty | 267/166 X |
| 3,195,256 | 7/1965 | Core | 40/156 |
| 3,748,455 | 7/1973 | Welton | 40/574 |
| 4,761,903 | 8/1988 | Cantrell | 40/158.1 |
| 4,862,610 | 9/1989 | Lawless | 40/156 |
| 4,905,390 | 3/1990 | Stilling | 40/574 |

FOREIGN PATENT DOCUMENTS

| | | | |
|---|---|---|---|
| 156403 | 2/1939 | Fed. Rep. of Germany | 40/574 |

*Primary Examiner*—Joseph Falk
*Assistant Examiner*—Cassandra Hope
*Attorney, Agent, or Firm*—Fay, Sharpe, Beall, Fagan, Minnich & McKee

[57] ABSTRACT

A display system comprising a transparent display face, a frame detail surrounding the display face, a concealed hinge for internally hinging the display case to the frame detail, a concealed magnetic catch for securing the display face to the frame detail in a closed position, and a plurality of spaced apart compression springs mounted within the frame detail for pressing a sheet to be displayed flush against the display face at a plurality of pressure points.

21 Claims, 8 Drawing Sheets

DISPLAY SYSTEM

FIELD OF THE INVENTION

This invention relates in general to display systems, and more particularly to a poster display having a self-hinged display face and means for urging a poster or other transparency flush against the display face.

BACKGROUND OF THE INVENTION

Poster display systems are known in the art for use in advertising or as information panels in institutions such as banks, retail establishments, entertainment facilities, educational environments, etc. Such prior art display systems are typically in the form of a thick box with frame detail comprising a pair of acrylic pieces which slide together with a poster sandwiched therebetween. One or more fluorescent lamps or other lighting sources are mounted behind the poster or transparency to provide back lighting thereof. As a result of the rear mounting of the light sources, such prior art display systems are typically of thick and bulky design. In addition, many such prior art systems provide access to change or replace a poster or transparency by means of external hinges, handles, etc., which make recess mounting of the displays difficult and sometimes impossible. Furthermore, rear mounting of the light sources in combination with plastic panel sandwich design is known to cause the poster or transparency to wrinkle and therefore pull away from the display face in response to thermal and/or humidity changes. Also, direct exposure to the ultra-violet rays produced by the lighting source is known to cause burning and eventual fading of the poster or transparency.

SUMMARY OF THE INVENTION

According to the present invention, a display system is provided which is of thin and unobtrusive design, incorporating a self-hinged display face which hinges internally of the display frame without exposing any mechanical components on the exterior. This permits the display to be recessed into a wall opening with only a very small reveal from the display face to the wall opening.

A plurality of compression springs are provided within the frame detail for urging the poster or transparency flush against the display face. The plurality of compression springs are spaced apart to form a system of pressure points which allow for thermal and/or humidity expansion and contraction of the poster without wrinkling or warping.

According to a preferred embodiment of the invention, light sources are provided adjacent the side and/or top and bottom edges of the frame in combination with strategically placed sheets of optical lighting film for diffusing the generated light evenly across the display face without directly exposing the poster or transparency to ultraviolet radiation. Peripheral mounting of the light sources facilitates the design of a thin frame detail, with enhanced aesthetic appeal.

DETAILED DESCRIPTION OF THE PREFERRED EMBODIMENT

Figure 2:
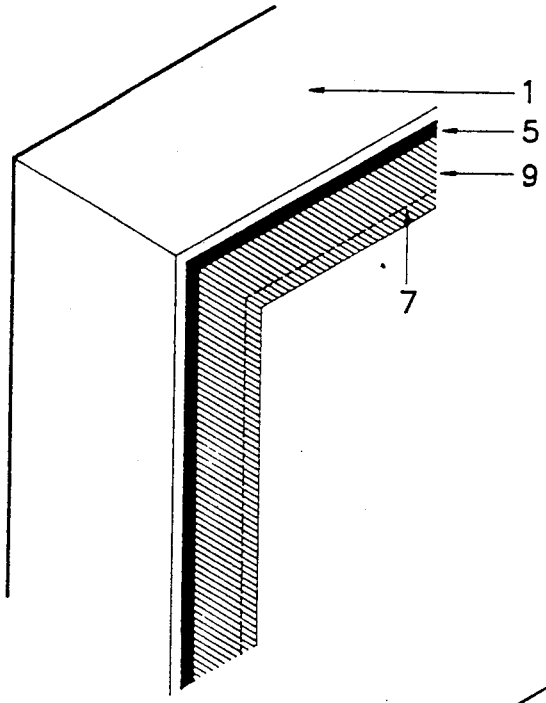
FIG. 2 is a detail perspective view of one corner of the display system shown in FIG. 1.
Figure 1:
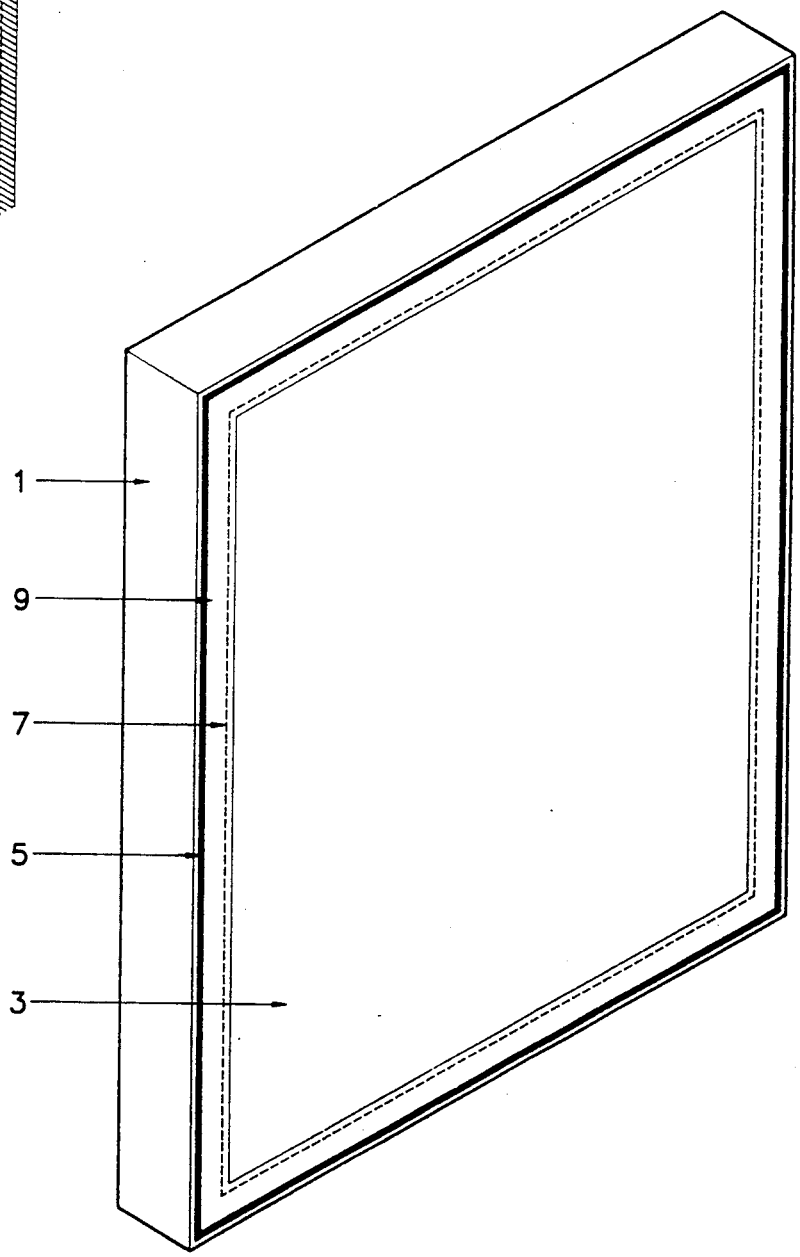
FIG. 1 is a perspective view of a display system according to the present invention.

With reference to FIGS. 1 and 2, a display system is shown according to the present invention comprising an extruded aluminum casing or frame 1 which can be provided with standard or custom painted finishes or architectural anodic finishes, or can also be cladded in stainless steel or architectural bronze.

A display face 3 is provided with a clear acrylic or vandal resistant polycarbonate panel for viewing an enclosed poster, transparency or other sheet of graphic material.

The casing or frame 1 and display face 3 are constructed to predetermined dimensions for providing a thin architectural reveal 5 extending around the perimeter of the display.

In the embodiment shown, the casing or frame 1 extends frontwardly of the display so as to be substantially flush with the front surface of display face 3. However, as will be discussed in greater detail below with reference to the alternative illustrated in FIG. 8, the absence of mechanical components on the exterior of the display system permits the display to be recessed into a wall opening with only a thin reveal to the wall opening, and in such a fashion that the casing 1 does not extend frontwardly to the plane of the display face, but instead functions merely as a frame for various internal structures and does not present any aesthetic effect to the display system.

The dotted line 7 in FIGS. 1 and 2 illustrates the outer limits of a poster or other transparency sheet positioned internally of the display system. A painted border 9 is provided behind the plastic door panel of display face 3 for concealing internal structures within the display system, as described in greater detail below. The border of painted graphic feed 9 can be provided in a wide range of standard colours to match colours within the poster to be displayed, or adapt to other aesthetic considerations.

Turning to FIGS. 3A–3D, a method is illustrated for replacing a first sheet 11A with a substitute sheet 11B within the display system of the present invention. Specifically, the display face 3 is hinged on the left side of the frame 1 to swing from a closed position (FIG. 3D) in which the display face 3 is latched shut by means of a concealed magnetic catch (not shown) which may be released by sliding a credit card 13 or other suitable means upwardly within the reveal 5 in the direction of the arrow shown in FIG. 3A. The concealed magnetic catch is discussed in greater detail below with reference to FIG. 7.

Upon releasing the concealed lock or catch by means of upward movement of the credit card 13, the display face 3 may be opened by pivoting around the internal hinges, the specifications of which are described in greater detail below with reference to FIG. 6.

Figure 3A:
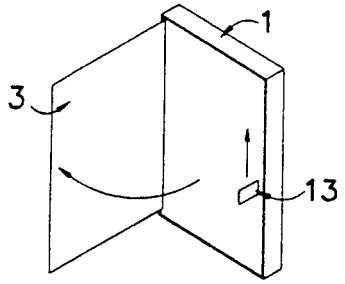
FIG. 3A–3D show the method for replacing a poster in the display system according to the present invention.
Figure 3C:
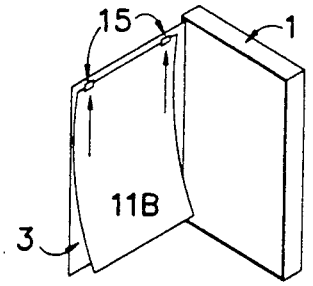
Figure 3B:
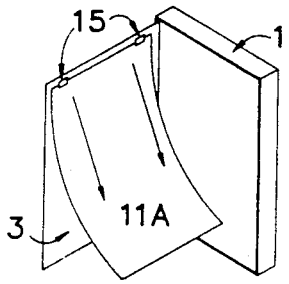

Turning to FIG. 3B, a pair of poster clips 15 are shown mounted to an inside surface of the display face 3 for holding the poster 11A in place. To remove the poster, a user need merely pull downwardly with thumb and forefinger with both hands at the bottom edge of the poster 11A.

In order to insert a new poster (FIG. 3C), the user merely slides the top edge of the poster 11B under the clips 15 at the top of the display face 3.

Figure 3D:
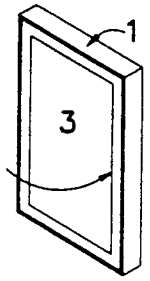

Finally, to lock the display panel shut, the face 3 may be swung to the closed position identified by the arrow in FIG. 3D, in response to which the concealed magnetic catch locks the display face shut.

Figure 4A:
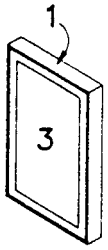
FIG. 4A–4H illustrate various mounting configuration of the display system.
Figure 4B:
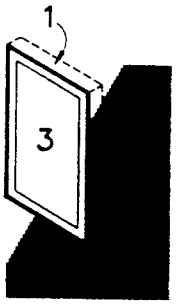
Figure 4C:
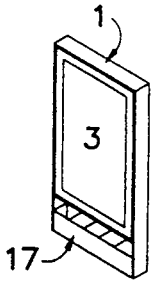
Figure 4D:
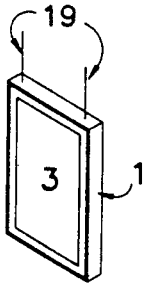
Figure 4E:
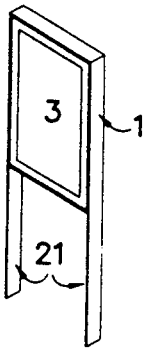
Figure 4F:
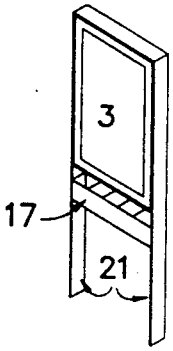
Figure 4G:
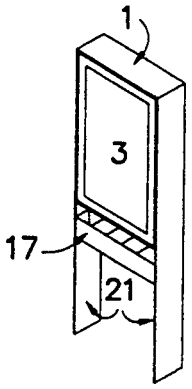
Figure 4H:
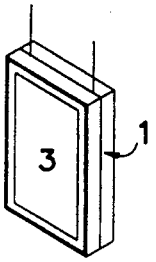

As discussed above, a plurality of mounting configurations are available, as shown in FIGS. 4A–4H. Specifically, FIG. 4A illustrates the display system in a surface mounted configuration. FIG. 4B shows the display system recess mounted, wherein the dashed lines indicate the hidden recess of the half casing 1. FIG. 4C shows the display system surface mounted with a brochure rack 17 provided therebelow. FIG. 4D shows the display system mounted for window display by means of a pair of cords 19. FIG. 4E shows the display system in a free standing configuration by means of a pair of downwardly extending legs 21. FIG. 4F illustrates the display system in free standing configuration with a brochure rack 17. FIGS. 4G and 4H illustrate a double-sided embodiment of the display system in free standing configuration and hanging display configuration, respectively.

Figure 5:
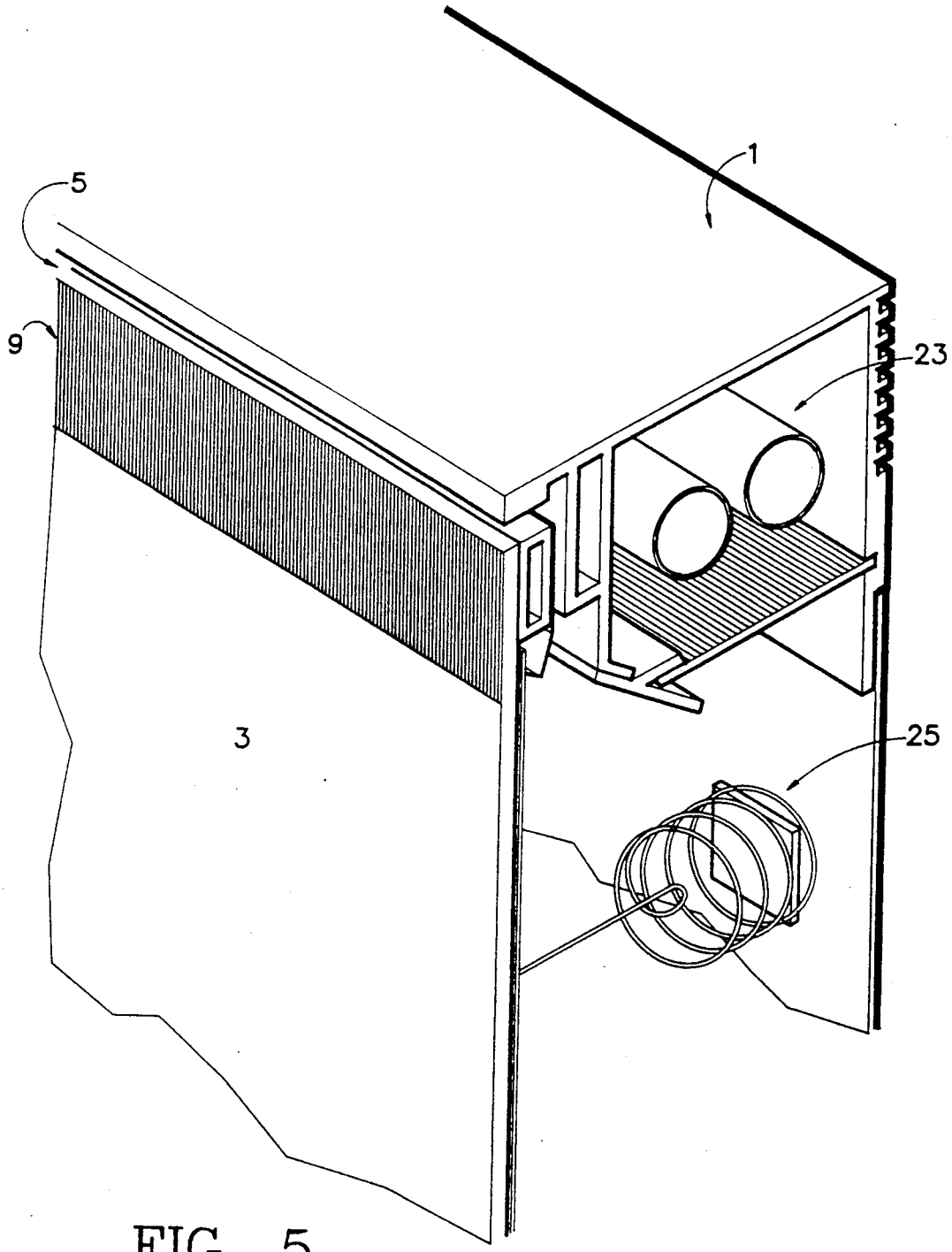
FIG. 5 is a schematic perspective view showing the inside of an illuminated version of the display.

FIG. 5 schematically represents an illuminated embodiment of the present invention in which a pair of bright and efficient fluorescent lamps 23 are located adjacent an edge of the casing 1, and a plurality of compression springs are provided to form a system of pressure points for maintaining the poster flat and legible against the display face 3 (one such compression spring 25 being illustrated in FIG. 5). As discussed briefly above, the system of pressure points provided by the compression springs 25 allow for thermal and humidity expansion and contraction of the poster without wrinkling, bowing, etc., of the poster or transparency.

Turning to the preferred embodiment of FIGS. 6–10, an internal hinge, magnetic catch and illuminating system ar illustrated in detail.

Figure 6:
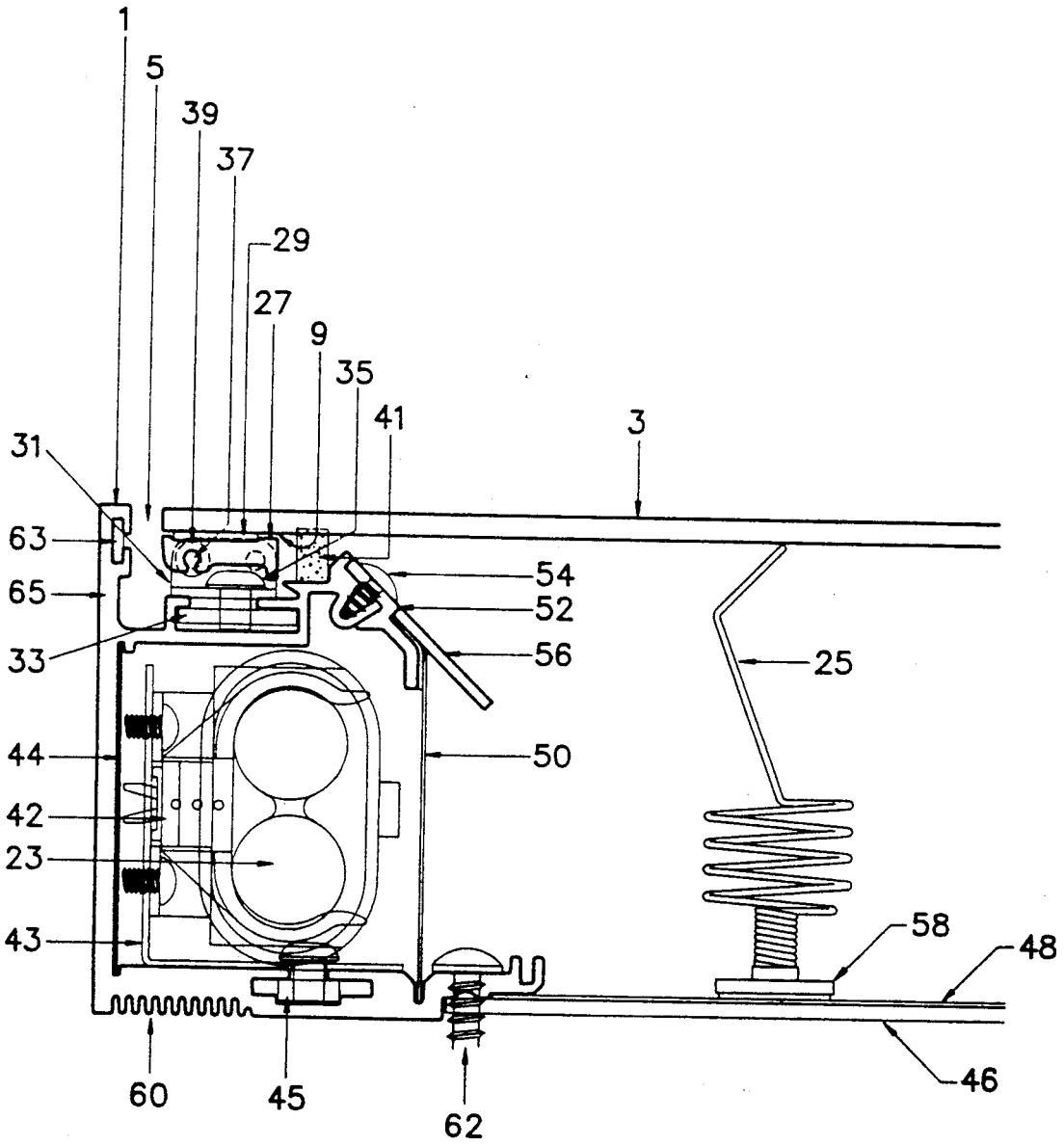
FIG. 6 is a cross-section view of a hinge within the display system according to the preferred embodiment.

Specifically, with reference to FIG. 6, an internal hinging system is shown for hinging a display face 3 to the extruded aluminum casing or frame 1. The hinge system comprises an extruded aluminum hinge frame 27 provided with a black anodic finish. The hinge frame 27 is preferably secured to the rear of the display face 3 via a layer of white acrylic foam tape affixed to the inside surface of the display face 3 and concealed by means of the painted margin 9.

A formed steel hinge 31 (shown in outline) is secured within a steel corner bracket 33 of the frame 1 by means of an Allen-drive-button head screw 35.

The hinge frame 27 and formed steel hinge 31 are connected for pivotal engagement by means of a steel roll pin 37 hammered into the extruded aluminum hinge frame 27 for pivoting within a clearance hole in the steel bracket 31. A nylon flat washer 39 is sandwiched between the formed steel hinge bracket 31 and the extruded aluminum hinge frame 27.

A polyester foam pressure pad 41 is adhesively connected to the casing 1 for maintaining an even pressure on the outer edges of the poster.

As can be seen from FIG. 6, the hinge arrangement is provided completely internally of the display system, with no exposed mechanical parts through the reveal 5. This yields a particularly pleasing aesthetic effect, and allows for recessed mounting of the display system as discussed in greater detail below with reference to FIG. 8.

Turning to the illumination system of the present invention, a pair of fluorescent lamps 23 are shown connected to the frame or casing 1 by means of a plastic lamp clip 42 connected to the frame or casing 1 by means of a formed steel lamp holder assembly 43. Lamp holder 43 is secured to casing 1 by means of button head screws into a square nut 45 captured in the casing 1 track, as illustrated.

As discussed briefly above, according to an aspect of the present invention, even back lighting of the poster or sheet may be obtained by side mounting of the fluorescent lamps 23 in conjunction with strategic placement of a plurality of sheets of optical lighting film. In particular, sheets of acrylic Scotch TM optical light film are provided behind the lamps 23 at 44 and on the back plate 46 of the casing or frame 1 at 48. In addition, a further sheet of Scotch TM optical light film (SOLF) is secured between the lamps 23 and the inside of the display system at 50 by means of an extruded aluminum lens capture section 52 fastened by means of a self tapping screw 54. The sheets of SOLF are provided at 44 and 48 with the smooth side of the film facing the interior of the display system, whereas the SOLF lens at 50 is oriented such that the smooth side faces the lamps 23.

Also adhered to the lens capture section 52 is a white acrylic diffuser strip 56 for further diffusing a bright stripe of light created by optical film.

One of the plurality of compression springs 25 is shown in detail secured to the back plate 46 by means of an injection moulded nylon self adhesive circuit board mount 58.

The spring 25 includes an obtuse angled extension configured so as to render the spring substantially invisible to a viewer when the display system is illuminated. Specifically, the axis of the distal portion of the spring extension is substantially parallel with the direction of the diffused light beams produced by the lamps 23.

The back plate 46 is also provided with a plurality of heat sink fins 60 adapted to dissipate heat generated by the lamps 23.

In the embodiment shown, the display system may be mounted to a wall by means of a plurality of wood screws, on such screw 62 being shown.

An aluminum casing alignment bracket 63 is also provided for adjusting alignment of the casing or frame 1.

Figure 7:
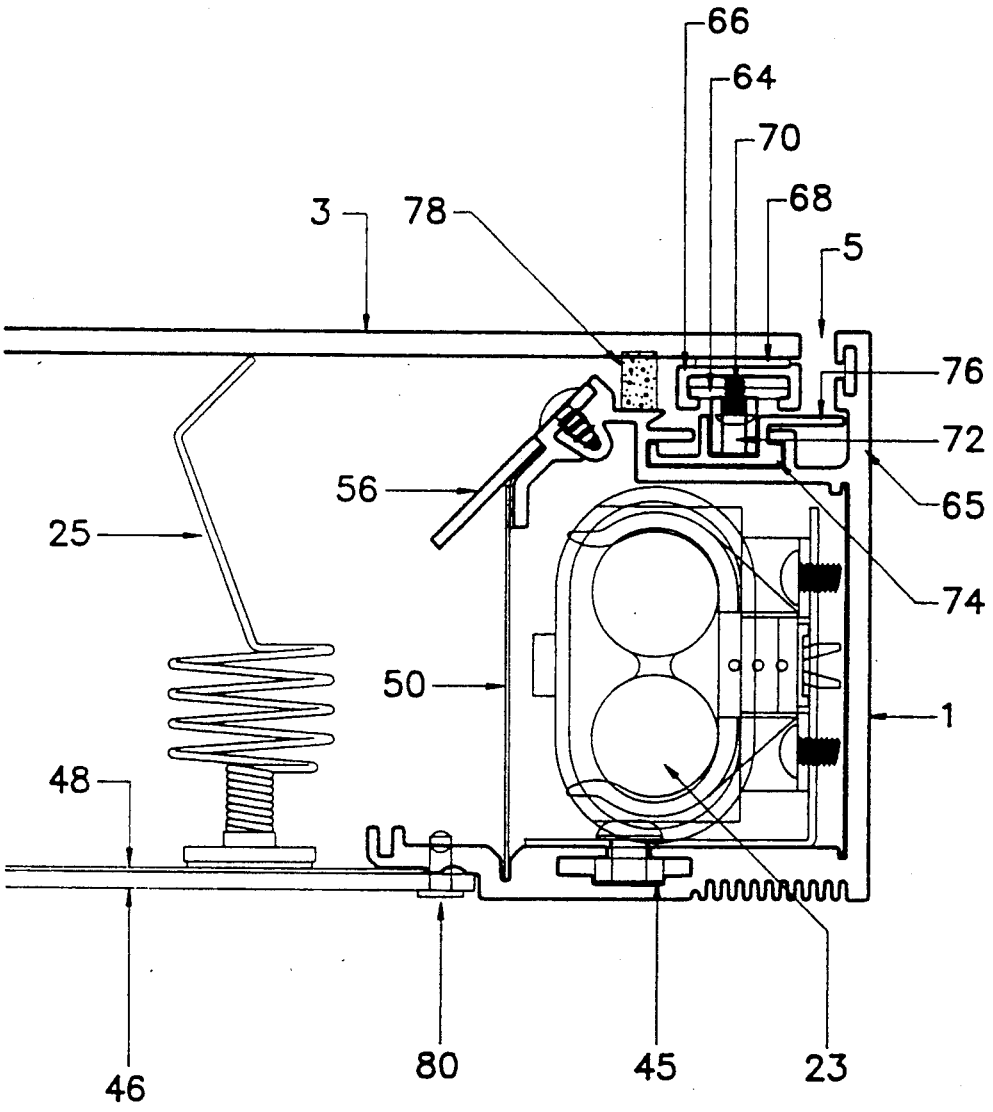
FIG. 7 is a cross-section view of a latch arrangement within the display system according to the preferred embodiment.

Turning to FIG. 7, the concealed magnetic catch of the preferred embodiment is shown comprising a steel magnet receiver plate 64 secured within an extruded aluminum jamb section 66 which is further secured to the display face 3 by means of a layer of wide white acrylic foam tape 68.

A set screw 70 holds the receiver plate 64 in place within the jamb section 66.

A pair of ceramic magnet assemblies 72 are adhered within an extruded aluminum slide bar 74 having an extension 76 which projects therefrom across the reveal 5 into a slot within the frame 1 to permit vertical movement of the slider bar 74 between the steel corner brackets.

A plurality of aluminum rivets 80 are provided for securing the back plate 46 to the casing or frame 1.

The remaining structural and illuminating elements within FIG. 7 correspond with like numbered elements discussed above with reference to the hinge depicted in FIG. 6.

In operation, a credit card 13 (FIG. 3A) may be inserted within the reveal 5 beneath the slider bar 76, and moved upwardly such that the slider bar 76 and attached magnet assemblies 72 are caused to slide upwardly and out of magnetic engagement with the magnet receiver plate 64, thereby releasing the display face 3.

Figure 8:
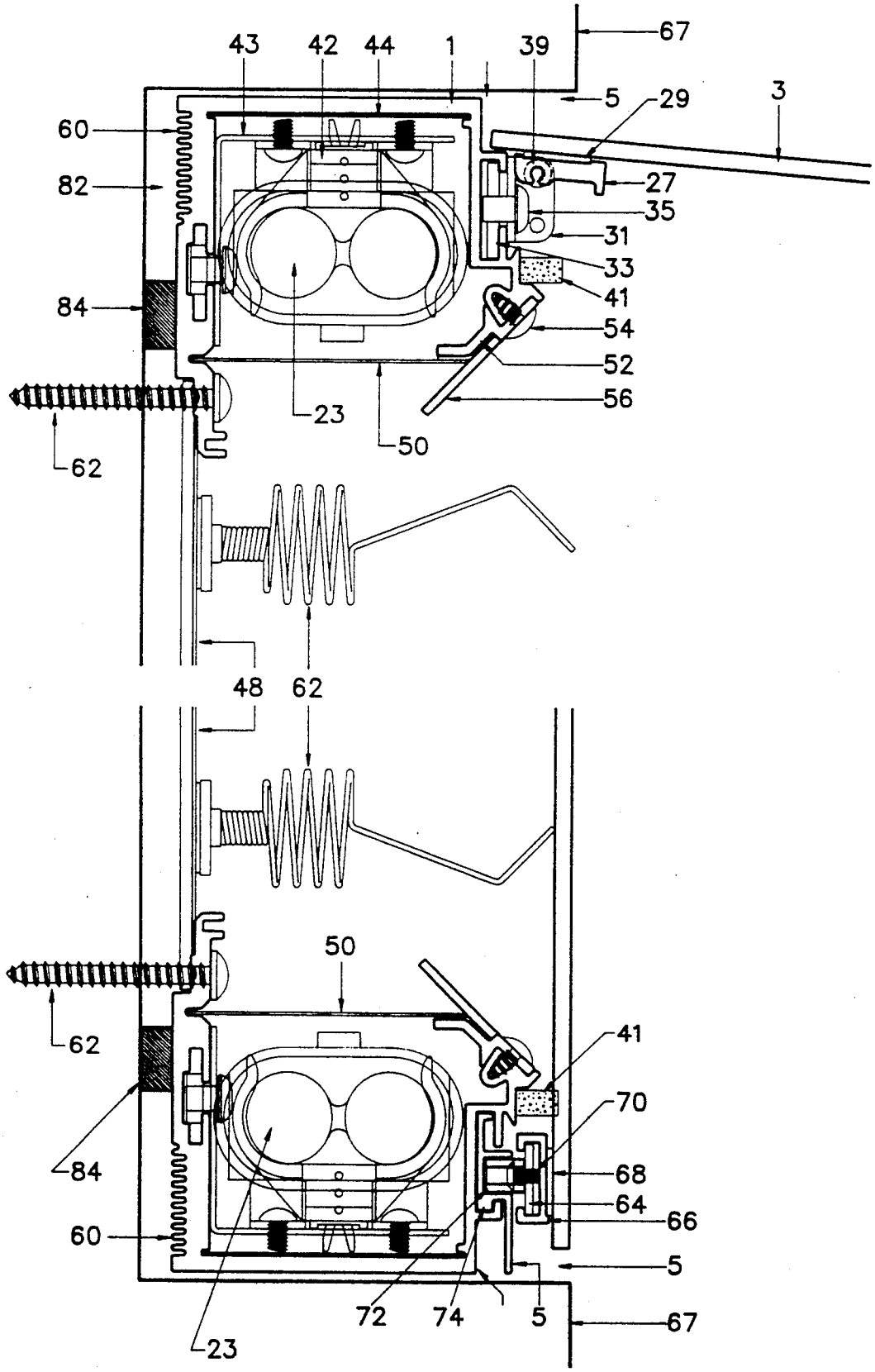
FIG. 8 is a partially broken cross-section view of the display system of the preferred embodiment recessed into a cavity.

Turning now to FIG. 8, an embodiment of the invention is shown in which the display is recessed into a cavity. The embodiment requires milling off of leg or extension member 65 of the casing 1 (see FIG. 6 and 7), resulting in a reveal 5 between the display face 3 and wall 67. The reference numerals indicated are identical to those of FIGS. 6 and 7. In the embodiment shown, the display face 3 is illustrated in a "hinge open" configuration on the left side of the Figure, whereas on the right side of the Figure the display face 3 is shown closed and engaged within the concealed magnetic catch.

According to the recessed mounting shown in FIG. 8, a predetermined spacing 82 is provided by means of spacers 84 in order to ensure adequate ventilation for dissipating heat generated by the heat sinks 60.

Figure 9:
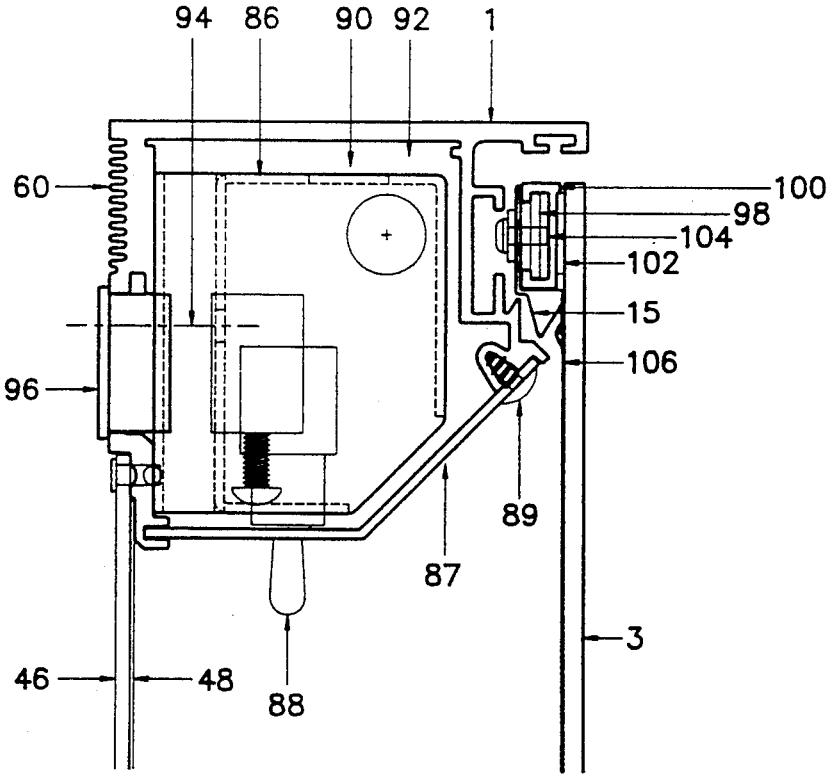
FIG. 9 is a cross section view through the top of the display according to the preferred embodiment.

Turning now to FIG. 9, a top section through the display is shown housing a formed steel junction box 86 encapsulating circuitry and wiring for operation of the fluorescent lamps 23. A toggle switch 88 is typically provided for enabling and disabling the lamps 23. An opening 90 is provided in the junction box 86 to set entry of an AC power cord as well as alternative exterior toggle switch 88. A clear space area 92 is provided for passing other wires by the junction box 86. The centre line at 94 indicates a line of mounting screws (not shown) required to fasten the junction box 86 in place. A snap bushing 96 is included for protecting the input power wire (not shown).

A steel plate 98 is mounted within a jamb section 100 which, in turn, is secured to the display face 3 by means of acrylic foam tape 102, as discussed above. The spring steel poster clip 15 is then screwed into the jamb section 100 by means of a button-head screw 104. The poster clip 15 is tapered at 106 to facilitate insertion of posters or translucent films.

A formed aluminum junction box cover plate 87 is screwed into the frame 1 by means of self tapping screws, such as screw 89.

Figure 10:
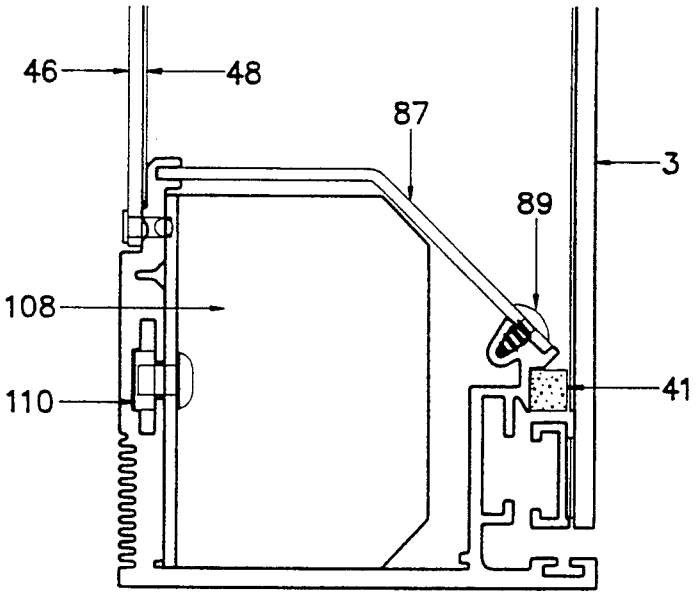
FIG. 10 is a cross-section view through the bottom of the display system according to the preferred embodiment.

In FIG. 10, a sectional view is shown through the bottom of the display, being of substantially identical proportions and shape as the top cross-section as discussed above with reference to FIG. 9. A space 108 is provided in which thermally protected lamp ballasts may be mounted away from the heat generated by the lamps 23. An Allen-drive-button-head machine screw 110 is threaded into a square nut located in an extruded channel within the frame 1.

Turning finally to FIGS. 11A–E, various configurations of the non-illuminated embodiment of the display system are depicted, in which reference numerals corresponding to those in FIGS. 1–10 are used to denote like components.

Figure 11A:
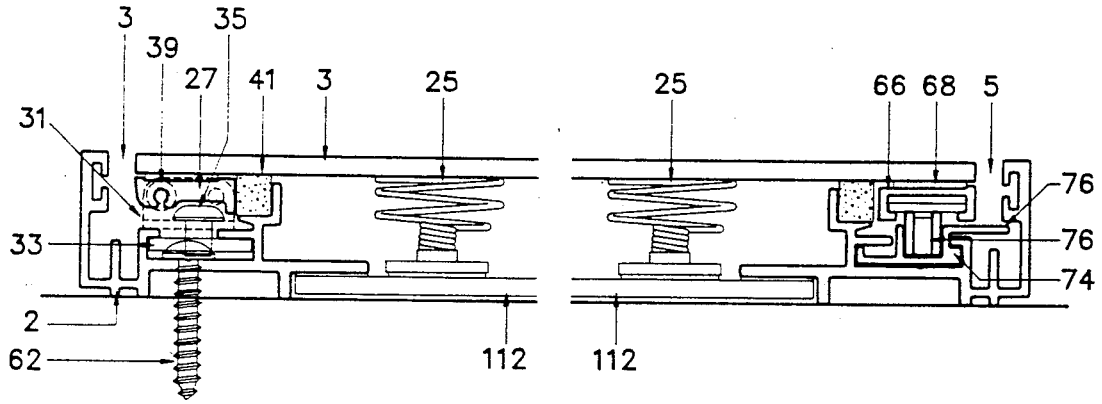
FIGS. 11A–11E are various cross-section views of a non-illuminated embodiment of the display system according to the present invention.

FIG. 11A shows a wall mounted non-illuminated poster display having a plurality of springs 25' of modified design to those depicted in FIGS. 6–8.

In the poster display of FIG. 11A, a Trovicel TM board 112 is used to support the springs 25'.

Figure 11D:
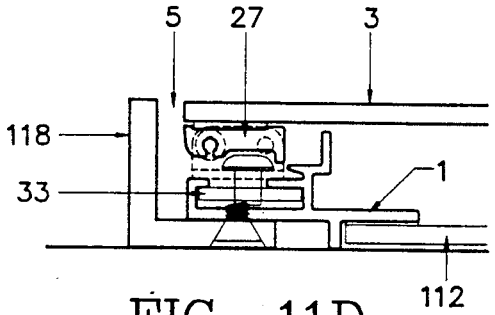
Figure 11B:
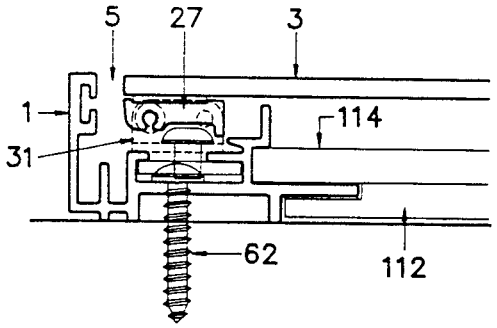

FIG. 11B shows a bulletin board configuration which is substantially similar to the poster display of FIG. 11A, with the addition of a Neo-Cor TM board 114 secured by the bracket 33, and into which thumb tacks may be inserted.

Figure 11E:
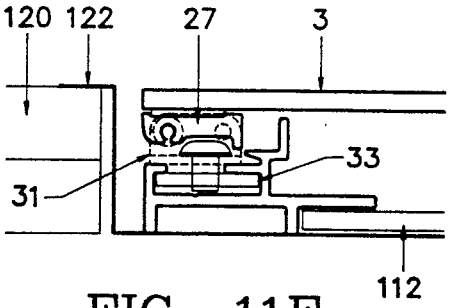
Figure 11C:
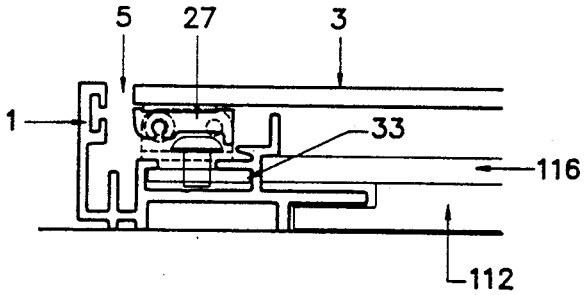

Turning to FIG. 11C, a changeable letter message board embodiment is shown further comprising a Trovicel TM board 112 and changeable letter board 116.

Alternative mounting configurations for the non-illuminated display system are illustrated in FIGS. 11D and 11E. Specifically, 11D shows a plated frame installation wherein a frame 1 is secured by means of a brass or stainless steel angle 118. FIG. 11E shows a recess mounting of the non-illuminated display system for installation within an opening in two ply drywall 120 by optional use of a drywall finishing formed steel pan 122.

Other embodiments or variations of the invention are possible within the sphere and scope of the claims appended hereto.

I claim:

1. A display system comprising a transparent display face, a frame detail surrounding said display face, means for internally hinging said display face to said frame detail, means for internally latching said display face to said frame detail in a closed position, means for retaining a sheet to be displayed within said frame detail, means for urging said sheet flush against said display face, wherein said display face and said frame detail are of respective predetermined dimensions for defining a reveal therebetween, wherein said means for internally latching further comprises a magnet receiver plate connected to an inside surface of said display face at a location adjacent to and internally of said reveal, a corner bracket extending from an inside surface adjacent to and internally of said reveal, a slider bar adapted to slide within said corner bracket between predetermined lower and upper positions, said slider bar including a portion which extends across said reveal, a magnetic assembly mounted to said slider bar and adapted to receive and engage said magnet receiver plate when said display face is in said closed position and said slider bar is in said lower position and to release and disengage said magnet receiver plate responsive to said slider bar being lifted to said upper position.

2. The display system of claim 1 wherein said means for internally hinging further comprises a hinge frame connected to an inside surface of said display face at a location adjacent to and internally of said reveal, a hinge bracket connected to said frame detail at said location adjacent to and internally of said reveal, and pivot means extending through each said hinge frame and hinge bracket enabling said display face to swing between an open and said closed position relative to said frame detail.

3. The display system of claim 2, further comprising a painted graphic feed overlying said hinge frame on an external surface of said display face for concealing said hinge frame within the frame detail.

4. The display system of claim 2, wherein said hinge frame is fabricated from extruded aluminum.

5. The display system of claim 2, wherein said hinge bracket is fabricated from formed steel.

6. The display system of claim 2, wherein said pivot means further comprises a steel roll pin extending through respective openings in said hinge frame and said hinge bracket, and a nylon flat washer surrounding said roll pin and lying between said hinge bracket and hinge frame.

7. The display system of claim 2, wherein said hinge bracket is connected to said frame detail by means of a corner bracket extending from an inside surface of said detail behind said reveal to said location adjacent to and internally of said reveal.

8. The display system of claim 1, further comprising a painted graphic feed overlying said magnet receiver plate on an external surface of said display face for concealing said receiver plate within the frame detail.

9. The display system of claim 1, wherein said display face is fabricated from one of either clear non-reflective acrylic or vandal-resistant polycarbonate.

10. The display system of claim 1, wherein said means for retaining further comprises a spring steel poster clip secured to an inside surface of said display face by means of a steel plate screwed into said display face at a location adjacent to and internally of said reveal.

11. The display system of claim 10, further comprising a painted graphic feed overlying said spring steel poster clip and steel plate on an external surface of said display face for concealing said spring steel poster clip and steel plate within the frame detail.

12. The display system of claim 1, further comprising means for illuminating said sheet from within said frame detail.

13. The display system of claim 12, wherein said means for illuminating further comprises one or more lamps adjacent said frame detail and optical lighting film means for diffusing light generated by said one or more lamps evenly across said sheet.

14. The display system of claim 13, wherein said optical lighting film means comprises at least one sheet of one optical lighting film intermediate respective ones of said lamps and the interior of said frame detail for diffusing the light generated by said lamps while reducing exposure of said sheet to ultraviolet rays, and a further sheet of said optical lighting film covering a rear surface of said detail.

15. The display system of claim 1, further comprising an extruded aluminum casing integral with said frame detail.

16. A display system comprising a transparent display face, a frame detail surrounding said display face, means for internally hinging said display face to said frame detail, means for internally latching said display face to said frame detail in a closed position, means for retaining a sheet to be displayed within said frame detail, means for urging said sheet flush against said display face, wherein said means for urging comprises a plurality of coiled compression springs mounted internally to a rear surface of said frame detail, each of said springs including a linear wire having a bent portion extending therefrom adapted to press said sheet against said display face at predetermined pressure points for allowing said sheet to expand and contact due to thermal and humidity changes without wrinkling.

17. The display system of claim 16, wherein each said plurality of coiled springs is mounted to said rear surface of said frame detail by an associated self adhesive circuit board mount.

18. The display system of claim 16, wherein said display face is fabricated from one of either clear non-reflective acrylic or vandal-resistant polycarbonate.

19. The display system of claim 16, wherein said means for retaining further comprises a spring steel poster clip secured to an inside surface of said display face by means of a steel plate screwed into said display face at a location adjacent to and internally of said reveal.

20. The display system of claim 16, further comprising means for illuminating said sheet from within said frame detail.

21. The display system of claim 16, further comprising an extruded aluminum casing integral with said frame detail.

* * * * *

UNITED STATES PATENT AND TRADEMARK OFFICE

CERTIFICATE OF CORRECTION

PATENT NO. : 5,174,056

DATED : December 29, 1992

INVENTOR(S) : William H. King

It is certified that error appears in the above-identified patent and that said Letters Patent is hereby corrected as shown below:

Claim 16, column 8, line 25, delete "contact" and substitute therefor ---contract---.

Signed and Sealed this

Fifth Day of April, 1994

Bruce Lehman

*Attest:*

BRUCE LEHMAN

*Attesting Officer*

*Commissioner of Patents and Trademarks*